US008629609B2

(12) United States Patent
Di Carlo et al.

(10) Patent No.: US 8,629,609 B2
(45) Date of Patent: Jan. 14, 2014

(54) HIGH FREQUENCY TRIODE-TYPE FIELD EMISSION DEVICE AND PROCESS FOR MANUFACTURING THE SAME

(75) Inventors: Aldo Di Carlo, Rome (IT); Claudio Paolini, Rome (IT); Eleonora Petrolati, Rome (IT); Francesca Brunetti, Frascatti (IT); Riccardo Riccitelli, Lariano (IT)

(73) Assignee: Selex Sistemi Integrati S.p.A., Rome (IT)

( * ) Notice: Subject to any disclaimer, the term of this patent is extended or adjusted under 35 U.S.C. 154(b) by 611 days.

(21) Appl. No.: 12/811,014

(22) PCT Filed: Dec. 28, 2007

(86) PCT No.: PCT/IT2007/000931

§ 371 (c)(1),
(2), (4) Date: Oct. 26, 2010

(87) PCT Pub. No.: WO2009/084054

PCT Pub. Date: Jul. 9, 2009

(65) Prior Publication Data

US 2011/0031867 A1 Feb. 10, 2011

(51) Int. Cl.
*H01J 1/62* (2006.01)
*H01J 27/00* (2006.01)

(52) U.S. Cl.
USPC ..... 313/495; 313/306

(58) Field of Classification Search
USPC ..... 313/495–497, 306, 310; 445/23–25, 445/49–51
See application file for complete search history.

(56) References Cited

U.S. PATENT DOCUMENTS 5,225,820 A * 7/1993 Clerc ..... 345/55
5,786,657 A * 7/1998 Okamoto ..... 313/308
6,522,080 B1 2/2003 Faillon et al.

FOREIGN PATENT DOCUMENTS

DE 196 09 234 9/1997
FR 2 789 801 8/2000

OTHER PUBLICATIONS

International Search Report in corresponding PCT/IT2007/000931 dated Oct. 1, 2008.
Written Opinion in corresponding PCT/IT2007/000931 dated Oct. 1, 2008.
International Preliminary Report on patentability in corresponding PCT/IT2007/000931 dated Mar. 17, 2010.
Pescini et al., "Nanoscale Lateral Field-Emission Triode Operating at Atmospheric Pressure," *Adv. Mater. 13*(23)1780-1783, Dec. 3, 2001.

* cited by examiner

*Primary Examiner* — Joseph L Williams
(74) *Attorney, Agent, or Firm* — Marshall, Gerstein & Borun LLP

(57) ABSTRACT

Disclosed herein is a triode-type field emission device, in particular for high frequency applications, having a cathode electrode, an anode electrode spaced from the cathode electrode, a control gate electrode arranged between the anode electrode and the cathode electrode, and at least a field-emitting tip; the cathode, control gate and anode electrodes overlapping in a triode area at the field-emitting tip and being operable to cooperate with the field-emitting tip for generation of an electron beam in the triode area. The cathode, control gate and anode electrodes do not overlap outside the triode area, and have a main direction of extension along a respective line; each of these respective lines being inclined at a non-zero angle with respect to each one of the others.

25 Claims, 4 Drawing Sheets

HIGH FREQUENCY TRIODE-TYPE FIELD EMISSION DEVICE AND PROCESS FOR MANUFACTURING THE SAME

TECHNICAL FIELD OF THE INVENTION

The present invention relates in general to a micro/nanometrical device belonging to the family of semiconductor vacuum tubes for high frequency applications, and more particularly to an innovative high frequency triode-type field emission device, and to a process for manufacturing the same.

BACKGROUND ART

As is known, technology and applications in the THz frequency range have traditionally been restricted to the field of molecular astronomy and chemical spectroscopy. However, recent advances in THz detectors and sources have opened the field to new applications, including homeland security, measurement systems (network analysis, imaging), biological and medical applications (cell characterization, thermal and spectral mapping), material characterization (near-field probing, food industry quality control, pharmaceutical quality control).

Although commercial uses for THz sensors and sources are growing, this growth is somehow limited by the difficulty of providing reliable THz sources, for which traditional semiconductor technology, due to poor electron mobility, has proven not satisfactory.

Use of vacuum electronics instead of semiconductor technology allows to exploit the property of electrons of reaching higher speeds in vacuum than in a semiconductor material, and thus to reach higher operating frequencies (nominally from GHz to THz). The general working principle of vacuum electronic devices is based on the interaction between an RF signal and a generated electron beam; the RF signal imposes a velocity modulation to the electrons of the electron beam permitting an energy transfer from the electron beam to the RF signal.

Conventional old-generation vacuum tubes included thermionic cathodes for generating the electron beam, operating at very high temperature (800° C.-1200° C.), and suffered from many limitations, among which: high electric power requirements, high heating-up time, instability problems and limited miniaturization.

The above limitations have been overcome with the introduction of vacuum devices with a FEA (Field Emission Array) cathode, that has led to significant advantages, in particular for THz frequency amplification, allowing to work at room temperature, and to achieve size reduction down to the micro- and nanometric dimensions. A FEA structure for RF sources was first proposed by Charles Spindt (C. A. Spindt et al., *Physical properties of thin-film field emission cathodes with molybdenum cones*, Journal of Applied Physics, vol. 47, December 1976, pages 5248-5263), and is usually referred to as the Spindt cathode (or cold cathode, due to the low operating temperature). In particular, Spindt cathode devices consist of micromachined metal field emitter cones or tips formed on a conductive substrate, and in ohmic contact therewith. Each emitter has its own concentric aperture in an accelerating field between an anode and a cathode electrodes; a gate electrode, also known as control grid, is isolated from the anode and cathode electrodes and the emitters by a silicon dioxide layer. With individual tips capable of yielding several tens of microamperes, large arrays can theoretically produce large emission current densities.

Performance of Spindt cathode devices are limited by damaging of the emitting tips due to material wear, and for this reason many efforts have been spent worldwide in searching innovative materials for their production.

In particular, the Spindt structure was much improved by using Carbon Nanotubes (CNTs) as cold cathode emitters (see for example S. Iijima, Helical microtubules of graphitic carbon, Nature, 1991, volume 354, pages 56-58, or W. Heer, A. Chatelain, D. Ugarte, *A carbon nanotube field-emission electron source*, Science, 1995, volume 270, number 5239, pages 1179-1180). Carbon nanotubes are perfectly graphitized, cylindrical tubes that can be produced with diameters ranging from about 2 to 100 nm, and lengths of several microns using various manufacturing processes. In particular, CNTs may be rated among the best emitters in nature (see for example J. M. Bonard, J.-P. Salvetat, T. Stockli, L. Forrò, A. Chatelain, *Field emission from carbon nanotubes: perspectives for applications and clues to the emission mechanism*, Applied Physics A, 1999, volume 69, pages 245-254), and therefore are ideal field emitters in a Spindt-type device; many studies have already acknowledged their field emission properties (see for example S. Orlanducci, V. Sessa, M. L. Terranova, M. Rossi, D. Manna, Chinese Physics Letters, 2003, volume 367, pages 109-114).

In this regard, FIG. 1 shows a schematic sectional view of a known Spindt-type cold cathode triode device 1, using CNTs as field emitters. The triode device 1 comprises a cathode structure 2; an anode electrode 3 spaced from the cathode structure 2 by means of lateral spacers 4; and a control gate 5 integrated in the cathode structure 2. The cathode structure 2 with the integrated control gate 5, and the anode electrode 3, are formed separately and then bonded together with the interposition of the lateral spacers 4. The anode electrode 3 is made up of a first conductive substrate functioning as the anode of the triode device, while the cathode structure 2 is a multilayer structure including: a second conductive substrate 7; an insulating layer 8 arranged between the second conductive substrate 7 and the control gate 5; a recess 9 formed to penetrate the control gate 5 and the insulating layer 8 so as to expose a surface of the second conductive substrate 7; and Spindt-type emitting tips 10 (only one of which is shown in FIG. 1, for simplicity of illustration), in particular CNTs, formed in the recess 9 in ohmic contact with the second conductive substrate 7, and functioning as the cathode of the triode device.

During operation, biasing of the control gate 5 allows controlling the flow of electrons generated by the cathode structure 2 towards the anode electrode 3, at the area corresponding to and surrounding the recess 9; the current thus generated is collected by the portion of the anode electrode 3 that is placed over the control gate 5.

In the triode device 1, a triode (or active) area can thus be defined (denoted with 1*a* in FIG. 1), including the region at, and closely surrounding, the emitting tips 10 and recess 9, in which electrons are generated and collected; and a triode biasing area 1*b*, as the region outside and external to the triode area 1*a*, through which biasing signals are conveyed to the same triode area.

OBJECT AND SUMMARY OF THE INVENTION

The Applicant has noticed that the topographic configuration of known Spindt-type vacuum tube triode devices suffers from an important limitation, due to the large value of parasitic capacitances existing between the control gate and the cathode and anode electrodes. This parasitic capacitance heavily limits the operating frequency that this type of device can reach, reducing the cut-off frequency, and making THz applications, even for micron scaled structures, substantially unfeasible.

In particular, known realization of the cold cathode devices envisages the presence of an extended control gate, which overlaps the conductive cathode substrate, thus forming two plates of a parasitic capacitor (denoted with $C_{GC}$ and shown schematically in FIG. 1). In detail, and assuming the control gate and cathode substrate to be modeled as two flat and parallel plates, the value of this parasitic gate-cathode capacitance $C_{GC}$ is given by $C=e_0e_r(A/d)$, wherein $e_0$ is the vacuum permittivity, $e_r$ is the relative permittivity of the insulating material between the cathode and the control gate, A is the area of overlap, and d is the distance between the cathode and the control gate. The parasitic gate-cathode capacitance $C_{GC}$ is also much larger than the capacitance between the control gate and the emitting tip (denoted with $C_{GT}$ in FIG. 1).

Moreover, the overlap between the anode electrode and the control gate generates a further parasitic capacitance, the gate-anode capacitance (denoted with $C_{GA}$ and shown schematically in FIG. 1), that adds up to the overall parasitic capacitance, determining a further degradation of the cut-off frequency of the device.

From the foregoing, it is evident that the operating frequency of this type of device is heavily dependent on, and strongly limited by, its topographic characteristics.

The main objective of the present invention is thus to provide an innovative topographical configuration for cold cathode vacuum tubes and an innovative manufacturing process, for the aforementioned drawback to be at least in part overcome.

This objective is achieved by the present invention in that it relates to a high frequency triode-type field emission device, and to a related manufacturing process, as defined in the appended claims.

The present invention achieves the aforementioned objective by varying the typical topography of a triode-type field emission device, and particularly by limiting the area of overlap between the cathode and anode electrodes and the control gate, thus reducing the value of the overall parasitic capacitance formed therebetween; the overlap between the different conductive surfaces is indeed limited to a triode area of the field emission device.

In detail, the control gate, anode and cathode electrodes are composed of a respective strip-shaped conduction line leading to a respective terminal; the various electrodes overlap only at the triode area (in particular with the terminals thereof, allowing generation and collection of the electron beam), while the various conduction lines are so arranged as not to overlap each other outside the same triode area. In more detail, the conduction lines, conducting electrical signals to/from the respective terminals, are inclined, one with respect to each of the other, at a non-zero angle, in particular at an angle of 60° (or 120°, if the complementary angle between any of the two lines is considered).

The advantages of the proposed structure are particularly significant in cathode array structures where contributions of all parasitic capacitances add up; in particular, the possibility of realizing large arrays of cold cathode devices without suffering for frequency limitation due to parasitic capacitances is one of the key issues of this structure.

BRIEF DESCRIPTION OF THE DRAWINGS

For a better understanding of the present invention, preferred embodiments, which are intended purely by way of example and are not to be construed as limiting, will now be described with reference to the attached drawings (all not drawn to scale), wherein.

DETAILED DESCRIPTION OF PREFERRED EMBODIMENTS OF THE INVENTION

Figure 1:
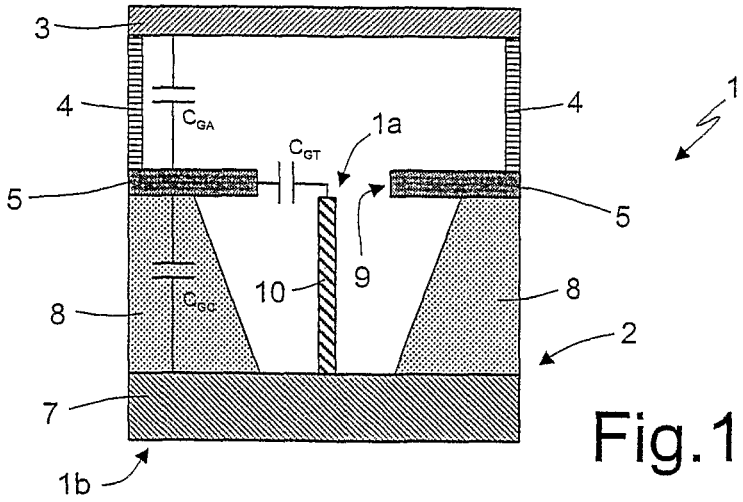
FIG. 1 shows a schematic cross-sectional view of a known Spindt-type cold cathode triode with a CNT as field emitter, and with parasitic capacitances highlighted.
Figure 2:
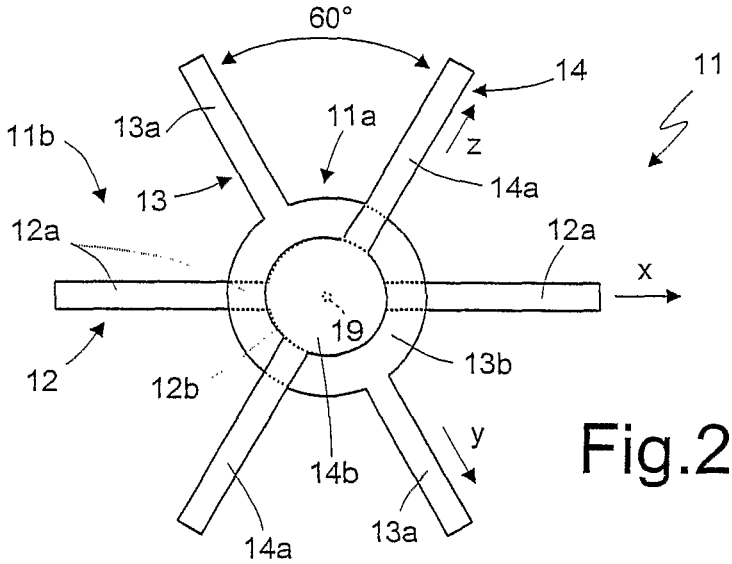
FIG. 2 is a schematic top view of a high frequency triode-type field emission device according to the present invention.
Figure 3:
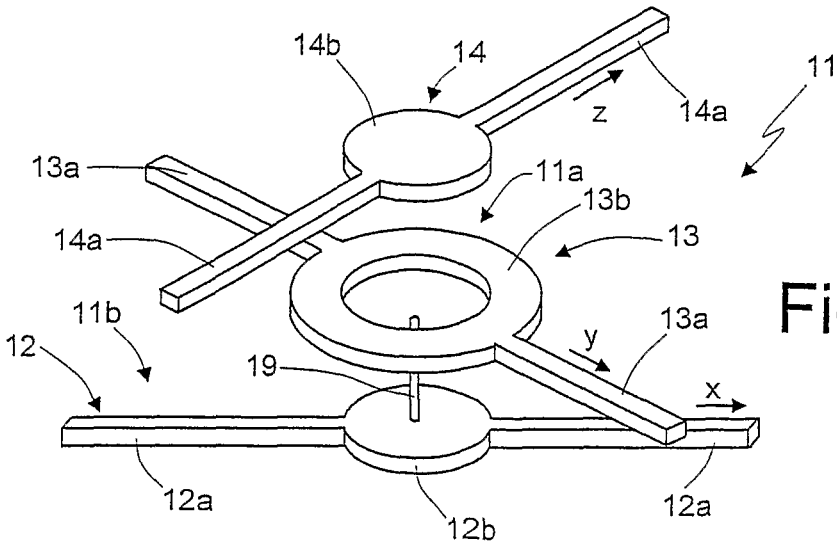
FIG. 3 is a schematic perspective exploded view of the high frequency triode-type field emission device of FIG. 2.
Figure 4:
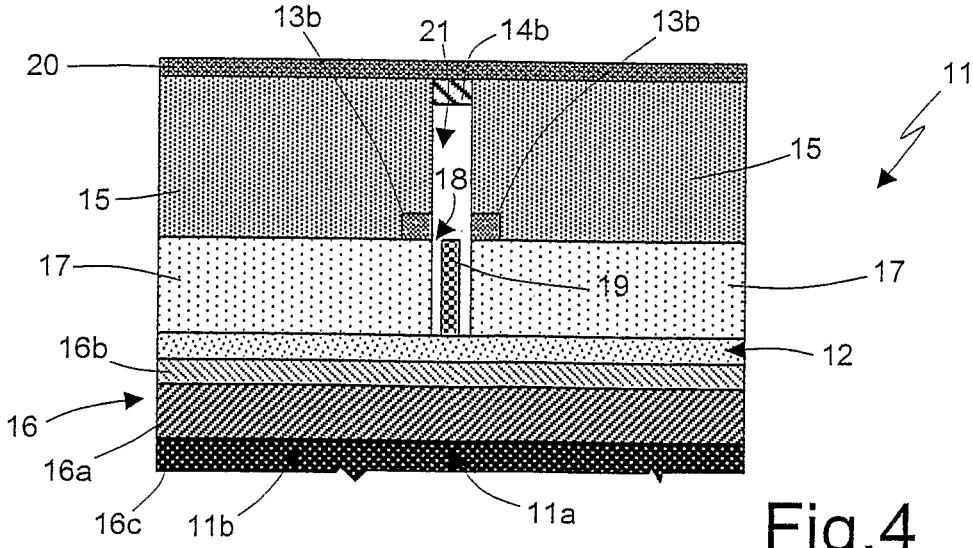
FIG. 4 is a cross sectional view of the high frequency triode-type field emission device according to a first embodiment of the present invention.

The following discussion is presented to enable a person skilled in the art to make and use the invention. Various modifications to the embodiments described will be readily apparent to those skilled in the art, and the generic principles herein may be applied to other embodiments and applications without departing from the spirit and scope of the present invention. Thus, the present invention is not intended to be limited to the embodiments shown, but is to be accorded the widest scope consistent with the principles and features disclosed herein and defined in the attached claims. FIGS. 2 and 3 show respectively a schematic top view and a perspective exploded view of a high-frequency triode-type field emission device 11 according to the present invention and defined as having a "crossbar structure", while FIG. 4 shows a cross sectional view of the high frequency triode-type field emission device 11, in accordance with a first embodiment of the present invention.

In detail, according to the first embodiment of the present invention, the high-frequency triode-type field emission device 11 comprises: a multilayered structure integrating a cathode electrode 12 and a control gate (or control grid) electrode 13; and an anode electrode 14, that is bonded to this multilayered structure, using vacuum bonding techniques, with lateral spacer 15 in order to maintain electrical isolation therebetween.

In more detail, the cathode electrode 12 is arranged over a substrate, in particular a multilayer substrate 16 including: a thick insulating layer 16*c*, that acts as a support for the whole structure; a conducting layer 16*a*, made of silicon or other semiconductor or conducting materials and acting as a ground plane for the device; and an overlying insulating layer 16*b*, made e.g. of silicon oxide. The cathode electrode 12 includes a cathode conduction line 12*a* and a cathode terminal 12*b*, the latter having a full disc shape. The cathode conduction line 12*a* has a strip-like shape with a main extension direction along a first direction x, leads to the cathode terminal 12*b*, and crosses it extending from opposite portions thereof along the first direction x; the cathode conduction line 12*a* is centered with respect to the cathode terminal 12*b*.

An insulating region 17, having the shape of an annulus, is arranged on the multilayer substrate 16 and the cathode electrode 12, and defines a first recess 18, formed therethrough so as to expose a top surface of the cathode terminal 12*b*. Spindt-type emitting tips 19 (only one of which is shown in FIGS. 2-4, for simplicity of illustration), in particular CNTs, are arranged on the exposed top surface of the cathode electrode 12*b* within the first recess 18.

The control gate electrode 13 is arranged over, and partially overlaps the cathode electrode 12, in particular it overlaps partially the cathode conduction lines 12*a* at a triode area 11*a* of the device (which, as previously, is defined as the area at, and closely surrounding, the emitting tips 19 and first recess 18, in which electrons are generated and collected). The control gate electrode 13 includes a gate conduction line 13*a* and a gate terminal 13*b*, the latter having a ring or annulus shape with an inner radius, that is e.g. equal to the radius of the cathode terminal 12*b*. The gate conduction line 13*a* has a strip-like shape with a main extension direction along a second direction y, and leads to the gate terminal 13*b*, extending from opposite portions thereof along the second direction y, without crossing it; the gate conduction line 13*a* is centered with respect to the gate terminal 13*b*. In particular, the first and second directions x, y define skew lines lying on parallel planes, and the second direction y is oriented by a non zero angle, in particular by an angle of 120° (or 60°, if the complementary angle is considered) with respect to the first direction x (the angle between the two lines being defined as either of the angles between any two lines parallel to them and passing through a same point in space).

The anode electrode 14 is arranged over the cathode electrode 12 and the control gate electrode 13, and partially overlaps them, in particular at the triode area 11*a*. The anode electrode 14 is formed on an insulating substrate 20 that is bonded to the multilayered structure integrating the cathode and control gate electrodes, with the interposition of the lateral spacer 15. In particular, the lateral spacer 15 has here an annulus shape and internally defines a second recess 21, that is equal to the first recess 18, and opens to the inside aperture of the gate terminal 13*b* and the same first recess 18, allowing flow of the generated electrodes towards the anode electrode 14.

In greater detail, the anode electrode 14 includes an anode conduction line 14*a* and an anode terminal 14*b*, the latter having a full disc shape with a radius equal to the radius of the cathode terminal 12*b*. The anode conduction line 14*a* has a strip-like shape with a main extension direction along a third direction z, and extends along the third direction z from opposite portions of the anode terminal 14*b*, being centered thereto. In particular, the second and third directions y, z are skew lines lying on parallel planes and the third direction z is oriented by a non zero angle, in particular by an angle of 120° (or 60°, if the complementary angle is again considered) with respect to the second direction y. Consequently, each of the first, second and third directions x, y, z is oriented by an angle of 60° (120°) with respect to each of the other ones.

From the foregoing description, it follows that overlapping between the different conductive regions of the triode device, i.e. the cathode, control gate and anode electrodes 12, 13, 14, is limited to the triode area 11*a* thereof, at which electrons are generated and directed from the cathode terminal 12*b* (and the emitting tips 19) to the anode terminal 14*b*. In particular, due to the structure spatial orientation, this overlap is limited to the cathode and anode terminals 12*b*, 14*b* (which fully overlap), and to a partial overlap between the gate terminal 13*b* and the cathode and anode conduction lines 12*a*, 14*a*. Advantageously; the cathode, gate and anode conduction lines 12*a*, 13*a*, 14*a* do not overlap each other.

FIGS. 5*a*-5*f* (where same reference numerals designate same elements as ones described before) show successive steps of the process for manufacturing the multilayered structure integrating the cathode and control gate electrodes of the high-frequency triode-type field emission device 11, according to the first embodiment of the present invention.

Figure 5A:
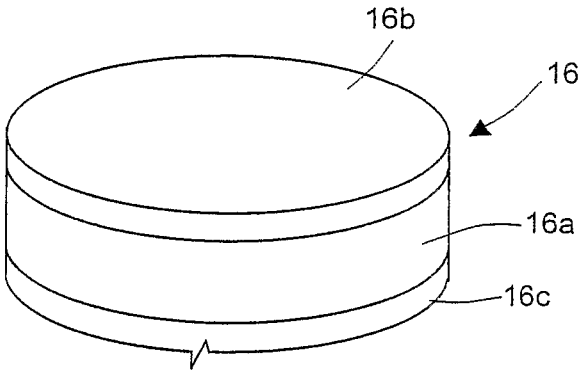
FIGS. 5*a*-5*f* are perspective views of a semiconductor wafer during successive steps of a process for manufacturing a cathode structure of the high frequency triode-type field emission device, according to the first embodiment of the present invention.

In detail, FIG. 5*a*, in an initial step of the process, a multilayered substrate 16 is provided, having an insulating layer 16*b*, e.g. a 4-μm oxide layer, formed by deposition or oxidation on a conducting layer 16*a*, made of silicon and having a thickness ranging from 2 to 10 μm (the conducting layer 16*a* acting as the ground plane of the device); the conducting layer 16*a* is realized on a thick insulating layer 16*c* (made of silicon dioxide or quartz).

Figure 5B:
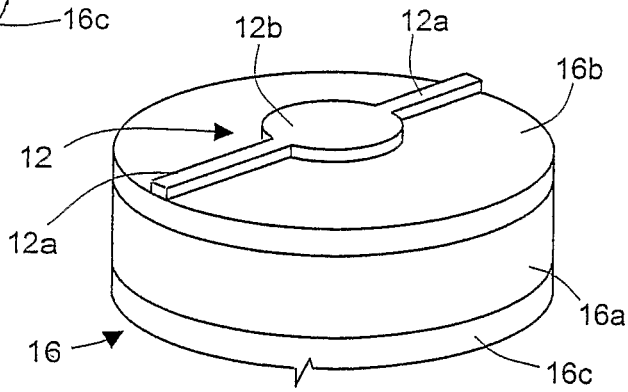
Figure 5C:
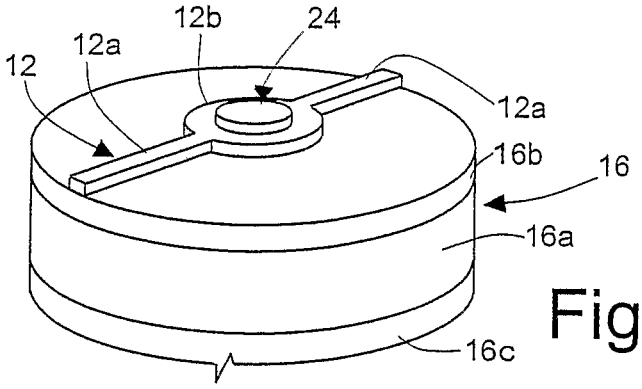

Next, FIG. 5*b*, a first metal layer is formed, e.g. by deposition, on the insulating layer 16*b*; a photoresist pattern (not shown) is defined on the first metal layer, and the same layer is etched to define the cathode electrode 12, having a strip-shaped cathode conduction line 12*a* and a disc-shaped cathode terminal 12*b*, coupled to the conduction line.

Using known techniques, such as for example e-beam lithography, a photoresist pattern (not shown) is aligned on the multilayered substrate 16, and a catalyst film (Fe or Ni) is deposited, e.g. by sputtering, and then lifted-off so as to leave only a catalyst region 24 (FIG. 5*c*) on the cathode terminal 12*b*, in particular at a center portion thereof. The thickness of the catalyst film is in the range of tens of nanometers (e.g. 5-50 nm).

Figure 5D:
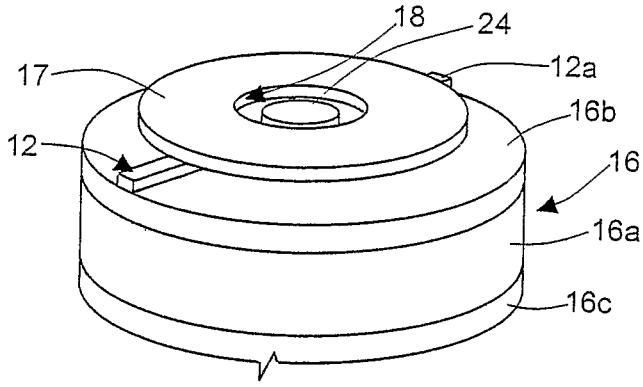

Using a further alignment, an insulating layer is deposited e.g. by sputtering, and then lifted-off, for the formation, FIG. 5*d*, of an insulating region 17, having the shape of an annulus surrounding the catalyst region 24. The insulating region 17 is designed to insulate the cathode conduction line 12*a* from the control gate terminal. The insulating layer is made of silicon oxide with a thickness in the range of microns.

Figure 5E:
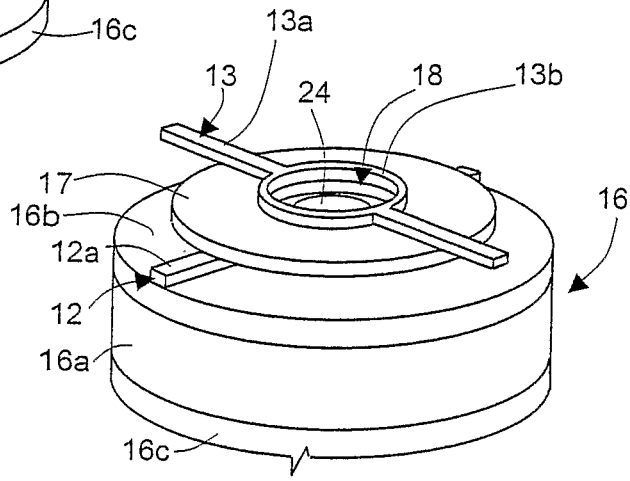

Again using a proper alignment, a second metal layer (not shown), for example of niobium, having a thickness of about 100 nm, is deposited and then lifted-off, so as to define the control gate electrode 13 (FIG. 5*e*). In particular, the control gate electrode 13 comprises a gate conduction line 13*a*, inclined at a non-zero angle with respect to the cathode conduction line 12*a*, and a gate terminal 13*b*, having an annulus shape with an inner opening facing the catalyst region 24. Then, an anodization process is carried out on the gate electrode 13, in order to reduce the current losses and to protect the same gate electrode during a subsequent CNT synthesis process.

Figure 5F:
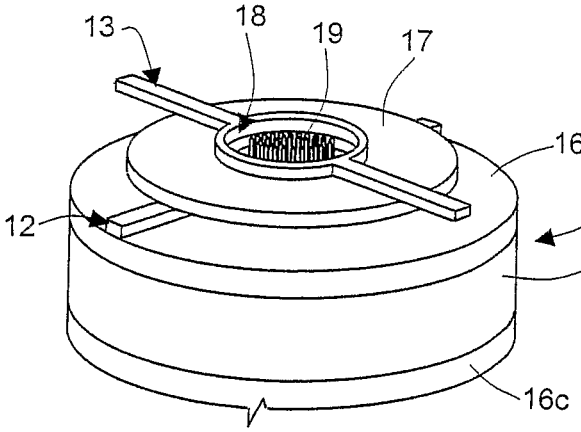

Next, FIG. 5*f*, the structure is submitted to CNTs synthesis in order to obtain (in a per se known manner) Spindt-type emitting tips 19; in particular, CNTs as field emitters are formed on the catalyst region 24.

The multilayered structure formed as described above and the anode electrode 14 are then aligned (taking into account the desired mutual orientation) and bonded together with the interposition of the lateral spacer 15, creating vacuum therebetween. In particular, the anode electrode 14 is first formed on the insulating substrate 20 (which is made e.g. of glass or silicon oxide), using common patterning techniques, and then the insulating substrate 20 is bonded to the multilayered structure using standard wafer-to-wafer vacuum bonding techniques, such as anodic bonding, glass frit bonding, eutectic bonding, solder bonding, reactive bonding or fusion bonding.

Given that a high quality vacuum is advantageous for ensuring reliable operation of the high-frequency triode-type field emission device 11, a variant of the described process (not shown in the Figures) may envisage the formation of a region containing a suitable reactive material such as Ba, Al, Ti, Zr, V, Fe, commonly known as a getter region. The getter region may allow, when appropriately activated, molecules desorbed during the bonding process to be captured. For a detailed description of the use of getter material to improve vacuum bonding, reference may be made to Douglas R. Sparks, S. Massoud-Ansari, and Nader Najafi, *Chip-Level Vacuum Packaging of Micromachines Using NanoGetters*, IEEE transactions on advanced packaging, volume 26, number 3, August 2003, pages 277-282, and Yufeng Jin, Zhenfeng Wang, Lei Zhao, Peck Cheng Lim, Jun Wei and Chee Khuen Wong, *Zr/V/Fe thick film for vacuum packaging of MEMS*, Journal of Micromechanics and Microengineering, volume 14, 2004, pages 687-692. In a way not shown, this getter region may for example be formed close to the anode electrode 14 inside the second recess 21 (the lateral spacer 15 being arranged so as to leave space for the formation of the getter region).

According to a second embodiment of the high-frequency triode-type field emission device 11, the control gate electrode 13 is integrated with the anode electrode 14, forming a multilayered structure therewith, instead of being integrated with the cathode electrode 12. This different structure has some specific advantages, as discussed in detail in co-pending patent application PCT/IT2006/000883 filed in the name of the same Applicant on 29 Dec. 2006, and in particular may prevent short circuits occurring between the control gate electrode 13 and the emitting tips 19, and further reduce the value of parasitic capacitances. The mutual spatial arrangement of the cathode, control gate and anode electrodes 12, 13, 14 does not change, so that mutual overlap is still limited to the triode area 11*a*, as previously discussed in detail. Since the second embodiment can be realized with simple modifications of the manufacturing process described for the first embodiment, the related manufacturing process will not be described again.

Figure 6:
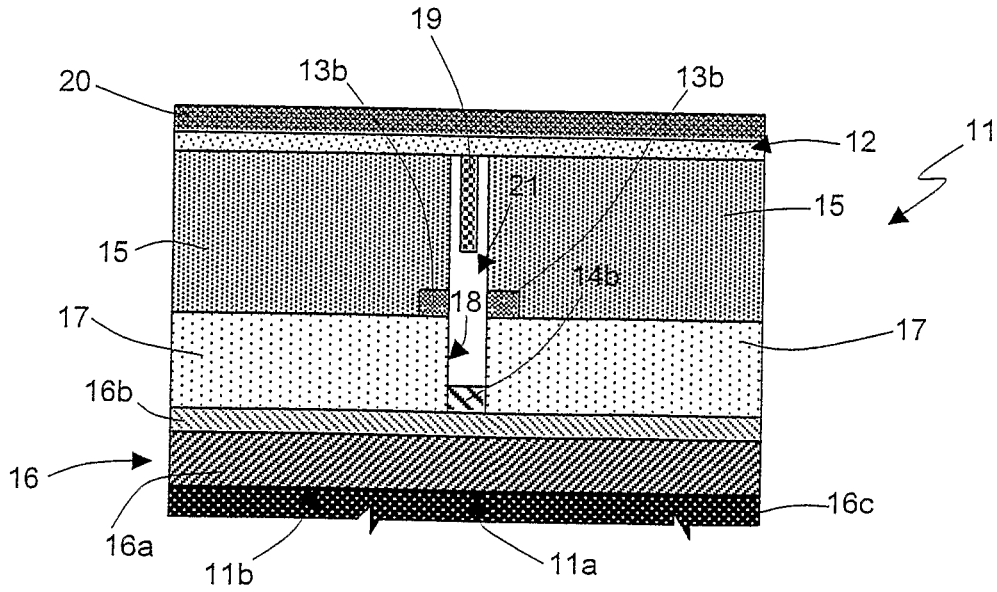
FIG. 6 is a cross sectional view of a high frequency triode-type field emission device according to a second embodiment of the present invention.

In detail, FIG. 6, the anode electrode 14 is in this case formed on the multilayer substrate 16, again including the thick insulating layer 16*c*, the conducting layer 16*a*, acting as a ground plane for the device, and the overlying insulating layer 16*b* in contact with the anode electrode 14. The insulating region 17 is arranged on the multilayer substrate 16 and the anode electrode 14, and defines the first recess 18, exposing a top surface of the anode terminal 14*b*. The control gate electrode 13 is arranged on the insulating region 17, with the inner opening of the gate terminal 13*b* open to the first recess 18.

The cathode electrode 12 is patterned on the insulating substrate 20, and the emitting tips 19 are formed on the exposed top surface of the cathode terminal 12*b*. The cathode electrode 12 and insulating substrate 20 are then bonded to the multilayer structure integrating the control gate and anode electrodes 13, 14, with the lateral spacers 15 maintaining electrical isolation therebetween.

Figure 7:
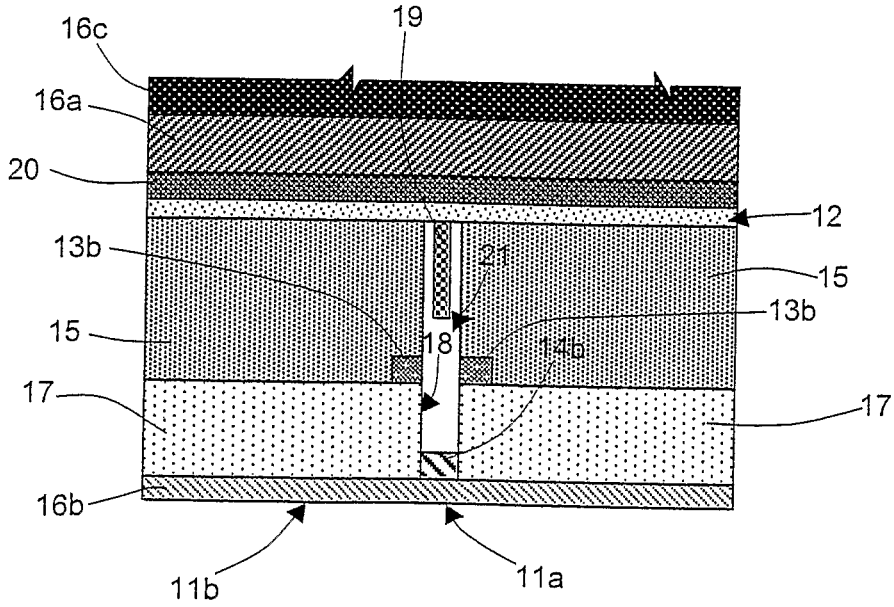
FIG. 7 is a variant of the high frequency triode-type field emission device of FIG. 6.

A possible variant of this second embodiment, FIG. 7, may provide for the ground plane (conducting layer 16*a*) to be coupled to the insulating substrate 20; the cathode electrode 12 is in this case patterned on the multilayer structure made by the insulating substrate 20 formed on the conducting layer 16*a*. The anode electrode 14, which is integrated with the control gate electrode 13, is instead formed on the insulating layer 16*b*.

Figure 8:
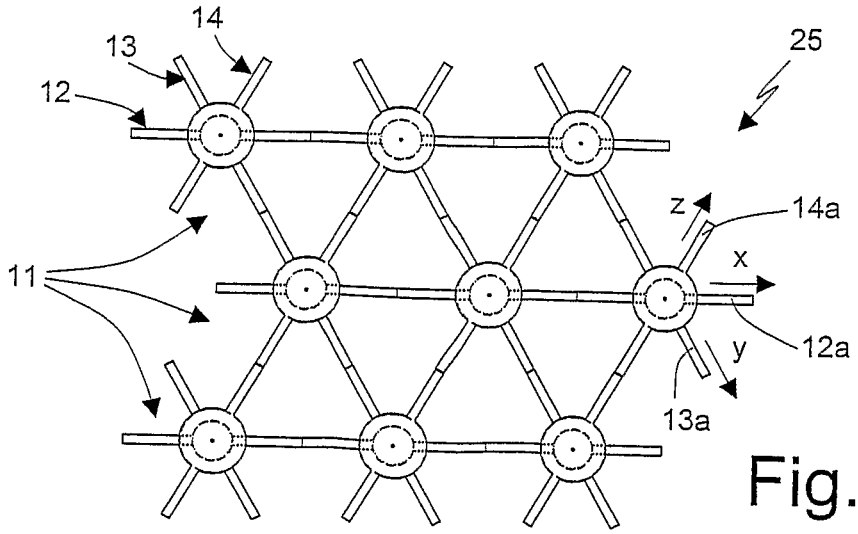
FIG. 8 is a schematic top view of an array of high frequency triode-type field emission devices according to a further embodiment of the present invention.

FIG. 8 shows a further embodiment of the present invention, envisaging the formation of an array 25 of a large number of high-frequency triode-type field emission devices 11, having the previously described "cross-bar structure".

In detail, the high-frequency triode-type field emission devices 11 of the array 25 are aligned along the first, second and third direction x, y, z. Each of the high-frequency triode-type field emission devices 11 in the array 25 shares its cathode, gate and anode conduction lines 12*a*, 13*a*, 14*a*, with other devices, with which it is aligned along the first, second and third direction x, y, z, respectively. As a result, the devices aligned in the first, second or third direction share a common conduction line, and in particular the cathode, gate or anode conduction line 12*a*, 13*a*, 14*a* directed along that direction; the high-frequency triode-type field emission devices 11 are thus arranged in an hexagonal lattice, providing for a regular, rational and compact area occupation.

The advantages of the triode-type field emission device according to the present invention are clear from the foregoing.

In particular, the envisaged cross-bar structure arrangement allows to strongly reduce the parasitic capacitance effects, and to really extend the operating frequency band of the device in the THz frequency range. This is mainly due to the overlap among the different metal surfaces (gate, cathode and anode electrodes) being limited to the triode area of the device, while outside the triode area no overlap is provided between these surfaces (and in particular between the various conduction lines). Thus, the value of the overall parasitic capacitance is heavily reduced.

A simple estimation of the maximum overlapping area to achieve a cut-off frequency of at least 1 THz is possible by considering commonly used expressions. In particular, considering a distance of 2 $g_m$ between the cathode and gate terminals 12*b*, 13*b*, it is possible to estimate that a maximum overlapping area of 20.000 $nm^2$ is requested to yield a cut-off frequency of 0.1 THz. An overlapping area with this value can easily be achieved by using an anodic and cathode circular area with a radius in the range of 0.5 μm, the cathode, gate and anode conduction lines 12*a*, 13*a*, 14*a* having a section of e.g. 0.1 μm.

With this arrangement, the estimated parasitic capacitance is in the range of $10^{-18}$ F, therefore taking into account a value of transconductance $g_m$ in the range of 0.1-50 μS and a DC gain in the range of 1-500 (see for example W. P. Kang, Y. M. Wong, J. L. Davidson, D. V. Kerns, B. K. Choi, J. H. Huang and K. F. Galloway, *Carbon nanotubes vacuum field emission differential amplifier integrated circuits*, Electronics Letters Vol. 42 No. 4, 2006 and Y. M. Wong, W. P. Kang, J. L. Davidson, J. H. Huang, *Carbon nanotubes field emission integrated triode amplifier array*, Diamond & Related Materials, vol. 15, p. 1990-1993, 2006) the cut-off frequency is in the range of THz.

Moreover, the described cross-bar structure, due to the reduced parasitic capacitance, is well suited for the integration of large arrays of field emitter devices in the THz frequency range. In particular, the chosen orientation for the conduction lines of the cathode, gate and anode electrodes 12, 13, 14, and in particular the inclination angle of 120°, allows to achieve a very limited overlap area, together with a rational integration of the array and a reduced area occupation, and it is accordingly particularly advantageous.

The realization of the proposed structure is well suited for CNT Spindt cold cathodes, since CNTs can be grown in well defined position by the use of a suitably patterned catalyst.

Furthermore, integration of the anode and control gate electrodes in a same structure (as shown in FIGS. 6 and 7)

may prove particularly advantageous, in order to further improve the electrical performances of the triode-type field emission device.

Finally, numerous modifications and variants can be made to the triode-type field emission device according to the present invention, all falling within the scope of the invention, as defined in the appended claims.

In particular, an initial step of the manufacturing process may envisage the provision of a SOI (Silicon On Insulator) multilayered substrate; in this case, the cathode electrode 12 (according to the first embodiment), or anode electrode 14 (according to second embodiment), may be formed by patterning of the silicon active layer of the SOI substrate, without having to deposit and etch an additional metal layer. SOI substrates have indeed already demonstrated to be suitable for the synthesis of carbon nanotubes.

Moreover, the internal vertical sides of the control gate electrode 13 could be spaced out from the internal vertical sides of the insulating region 17 (and the inner radius of the control gate electrode 13 thus be higher than the radius of the cathode and anode terminals 12*b*, 14*b*), so as to be covered by the lateral spacers 15 during the bonding process; this solution may allow a reduction of the leakage currents.

A variant of FIG. 4 could also be envisaged, corresponding to that of FIG. 7, having the conductive layer 16*a* (the ground plane) coupled to the insulating substrate 20 and not to the insulating layer 16*b*.

Additionally, it may readily be appreciated that the thickness of the various layers of the device and the various steps of the manufacturing process are only indicative and may be varied according to specific needs. In particular, for sake of simplicity, the description of the manufacturing process has made reference to manufacturing of a single cathode structure; however, the manufacture of an array of cathode structures simply requires the use of modified lithographical masks in which a same base structure is repeated.

The invention claimed is:

1. A triode-type field emission device, in particular for high frequency applications, comprising:

a multilayered structure integrating:

a cathode electrode, an anode electrode spaced from the cathode electrode, a control gate electrode arranged between said anode electrode and said cathode electrode, and at least a field-emitting tip;

wherein i) said cathode electrode, control gate electrode, and anode electrode are formed to overlap within a triode area at said field-emitting tip and to cooperate with said field-emitting tip to generate an electron beam in said triode area, and ii) at most two of said cathode electrode, control gate electrode, and anode electrode overlap at any point outside said triode area.

2. The device according to claim 1, wherein said multilayered structure further includes a substrate comprising an electrically conductive layer operable as a ground plane for said device, whereby said electron beam is substantially orthogonal to said electrically conductive layer.

3. The device according to claim 2, wherein said multilayered structure is a stacked structure.

4. The device according to claim 1, wherein each of said cathode electrode, control gate electrode, and anode electrode has a main direction of extension along a respective line; each of said respective lines being inclined at a non-zero angle with respect to each one of the others.

5. The device according to claim 4, wherein said angle is about 60°.

6. The device according to claim 1, wherein each of said cathode electrode, control gate electrode, and anode electrode includes a respective terminal at said triode area, and a respective conduction line extending from said respective terminal to a biasing area outside said triode area, and operable to conduct electrical signals for said respective terminal; the conduction lines of said cathode electrode, control gate electrode, and anode electrode being mutually arranged so as not to overlap.

7. The device according to claim 6, wherein said conduction lines of each of said cathode electrode, control gate electrode, and anode electrode extends along a respective line; each of said respective lines being inclined at a non-zero angle with respect to each one of the others.

8. The device according to claim 7, wherein said angle is about 60°.

9. The device according to claim 6, wherein the terminals of said cathode electrode and said anode electrode overlap at said triode area, and the terminal of said control gate electrode partially overlaps the conduction lines of said cathode electrode and said anode electrode at said triode area.

10. The device according to claim 9, wherein said conduction lines of said cathode electrode, control gate electrode, and anode electrode have a strip-like shape, are connected to said respective terminal, and extend along a respective line from opposite portions of said respective terminal.

11. The device according to claim 9, wherein the terminal of said cathode electrode has a disc shape, and is surmounted by said field-emitting tip and is in ohmic contact therewith; the terminal of said control gate electrode has an annulus shape defining a recess opening towards said field-emitting tip; and the terminal of said anode electrode has a disc shape overlying said recess and field-emitting tip; an internal radius of the terminal of said control gate electrode being no smaller than the radii of the terminals of said cathode electrode and anode electrode.

12. The device according to claim 1, further comprising a cathode structure including said cathode electrode and an anode structure including said anode electrode, said cathode and anode structures being formed separately and bonded together with the interposition of spacers; wherein said control gate electrode is integrated in said anode structure.

13. An array comprising a plurality of triode-type field emission devices, in particular for high frequency applications, each device comprising a multilayered structure integrating a cathode electrode, an anode electrode spaced from the cathode electrode, a control gate electrode arranged between said anode electrode and said cathode electrode, and at least a field-emitting tip; wherein i) said cathode electrode, control gate electrode, and anode electrode are formed to overlap at a triode area at said field-emitting tip and to cooperate with said field-emitting tip to generate an electron beam in said triode area, and ii) at most two of said cathode electrode, control gate electrode, and anode electrode overlap at any point outside said triode area.

14. The array according to claim 13, wherein each of said cathode electrode, control gate electrode, and anode electrodes has a main direction of extension along a respective line, each of said respective lines being inclined at a non-zero angle with respect to each one of the others, and includes a respective conduction line arranged along said respective line; and wherein said triode-type field emission devices are aligned along said respective lines, the devices aligned along a given line sharing a common conduction line, and in particular the conduction line of said cathode electrode, control gate electrode, or anode electrode that is directed along said given line.

15. The array according to claim 13, wherein said triode-type field emission devices are arranged in an hexagonal lattice.

16. A process for manufacturing a triode-type field emission device, in particular for high frequency applications, comprising forming a multilayered structure integrating a cathode electrode, an anode electrode spaced from the cathode electrode, a control gate electrode arranged between said anode electrode and said cathode electrode, and at least a field-emitting tip; wherein i) said cathode electrode, control gate electrode, and anode electrode are formed to overlap at a triode area at said field-emitting tip and to cooperate with said field-emitting tip to generate an electron beam in said triode area, and ii) at most two of said cathode electrode, control gate electrode, and anode electrode overlap at any point outside said triode area.

17. The process according to claim 16, wherein said multilayered structure further includes a substrate comprising an electrically conductive layer operable as a ground plane for said device, whereby said electron beam is substantially orthogonal to said electrically conductive layer.

18. The process according to claim 17, wherein said multilayered structure is a stacked structure.

19. The process according to claim 16, wherein arranging includes arranging the main directions of extension of each of said cathode electrode, control gate electrode, and anode electrode along a respective line; each of said respective lines being inclined at a non-zero angle with respect to each one of the others.

20. The process according to claim 19, wherein said angle is about 60°.

21. The process according to claim 16, wherein forming said cathode electrode, control gate electrode, and anode electrode includes forming a respective terminal thereof at said triode area, and a respective conduction line thereof extending from said respective terminal to a biasing area outside said triode area, said respective conduction line operable to conduct electrical signals for said respective terminal; and wherein arranging includes mutually arranging the conduction lines of said cathode electrode, control gate electrode, and anode electrode so as not to overlap.

22. The process according to claim 21, wherein mutually arranging includes positioning said conduction lines of each of said cathode electrode, control gate electrode, and anode electrode along a respective line; each of said respective lines being inclined at a non-zero angle with respect to each one of the others.

23. The process according to claim 22, wherein said angle is about 60°.

24. The process according to claim 21, wherein arranging includes arranging said terminals of said cathode electrode and said anode electrode so as to overlap at said triode area, and the terminal of said control gate electrode so as to partially overlap the conduction lines of said cathode electrode and said anode electrode at said triode area.

25. The process according to claim 16, further comprising forming separately a cathode structure and an anode structure on a respective insulating substrate, said step of forming a cathode structure including forming said cathode electrode and said step of forming said anode structure including forming said anode electrode; and then bonding together said cathode and anode structures with the interposition of spacers; wherein forming said control gate electrode includes integrating said control gate electrode in said anode structure.

* * * * *

UNITED STATES PATENT AND TRADEMARK OFFICE

CERTIFICATE OF CORRECTION

PATENT NO. : 8,629,609 B2
APPLICATION NO. : 12/811014
DATED : January 14, 2014
INVENTOR(S) : Aldo Di Carlo et al.

It is certified that error appears in the above-identified patent and that said Letters Patent is hereby corrected as shown below:

Title Page

Item (75), last name of second inventor, "Paolini" should be -- Paoloni --.

Item (75), city of residence for fourth named inventor, "Frascatti" should be -- Frascati --.

Signed and Sealed this
Sixteenth Day of September, 2014

Michelle K. Lee

Michelle K. Lee
*Deputy Director of the United States Patent and Trademark Office*